US007222597B2

(12) United States Patent
Auchter et al.

(10) Patent No.: US 7,222,597 B2
(45) Date of Patent: May 29, 2007

(54) INTERNAL COMBUSTION ENGINE HAVING A HYDRAULIC DEVICE FOR ADJUSTING THE ROTATION ANGLE OF A CAMSHAFT RELATIVE TO A CRANKSHAFT

(75) Inventors: Jochen Auchter, Weisendorf (DE); Andreas Strauss, Forchheim (DE); Lutz Witthöft, Aurachtal (DE); Michael Busse, Herzogenaurach (DE); Dirk Heintzen, Weisendorf (DE); Jürgen Plate, Gerhardshofen (DE)

(73) Assignee: INA-Schaeffler KG (DE)

( * ) Notice: Subject to any disclaimer, the term of this patent is extended or adjusted under 35 U.S.C. 154(b) by 0 days.

(21) Appl. No.: 11/152,703

(22) Filed: Jun. 14, 2005

(65) Prior Publication Data

US 2005/0274344 A1 Dec. 15, 2005

(30) Foreign Application Priority Data

Jun. 15, 2004 (DE) ..... 10 2004 028 868

(51) Int. Cl.
*F01L 1/34* (2006.01)

(52) U.S. Cl. ..... 123/90.17; 123/90.15; 123/90.31

(58) Field of Classification Search ..... 123/90.17, 123/90.15, 90.31
See application file for complete search history.

(56) References Cited

U.S. PATENT DOCUMENTS 4,854,273 A * 8/1989 Uesugi et al. ..... 123/90.17
5,189,999 A * 3/1993 Thoma ..... 123/90.17
6,035,819 A * 3/2000 Nakayoshi et al. ..... 123/90.17
6,866,066 B2 * 3/2005 Weber ..... 138/31

FOREIGN PATENT DOCUMENTS

| | | |
|---|---|---|
| DE | 198 37 693 | 2/1999 |
| DE | 199 03 624 | 8/1999 |
| DE | 198 34 143 | 2/2000 |
| DE | 199 63 094 | 6/2001 |
| DE | 101 12 206 | 9/2002 |

OTHER PUBLICATIONS

German Search Report 10 2004 028 868.2 dated Mar. 10, 2005.

* cited by examiner

*Primary Examiner*—Thomas Denion
*Assistant Examiner*—Zelalem Eshete
(74) *Attorney, Agent, or Firm*—Ostrolenk, Faber, Gerb & Soffen, LLP

(57) ABSTRACT

A hydraulic device for adjusting the rotation angle of a camshaft relative to a crankshaft in an internal combustion engine. The device has a rotor, with blades arranged around its periphery. A stator is connected in a rotationally secure manner to a drive wheel. The rotor and the stator together form pressure chambers, which can be filled with hydraulic fluid via a hydraulic fluid system, in which there is disposed a volume accumulator.

13 Claims, 3 Drawing Sheets

INTERNAL COMBUSTION ENGINE HAVING A HYDRAULIC DEVICE FOR ADJUSTING THE ROTATION ANGLE OF A CAMSHAFT RELATIVE TO A CRANKSHAFT

FIELD OF THE INVENTION

The invention relates to an internal combustion engine having a hydraulic device for adjusting the rotation angle of a camshaft relative to a crankshaft. The device comprises a rotor with blades arranged thereon. The rotor is connected in a rotationally secure manner to the camshaft. It includes a stator, which is connected in a rotationally secure manner to a drive wheel driven by the crankshaft. Pressure chambers are provided in the rotor on both circumferential sides of the rotor blades which extend into the pressure chambers. The chambers can be pressurized or depressurized with hydraulic fluid via a hydraulic system.

BACKGROUND OF THE INVENTION

A device of this general type is known from DE 199 63 094 A1. This device is configured as a so-called vane-type adjuster and essentially comprises a stator, which is in drive connection with a crankshaft of the internal combustion engine and is connected in a rotationally secure manner to a drive wheel, and a rotor, which is connected in a rotationally secure manner to a camshaft of the internal combustion engine. The stator here has a cavity, which is formed by a hollow-cylindrical peripheral wall and two side walls and in which hydraulic working spaces are formed by limit walls. The rotor includes a wheel hub and has, on the periphery of the wheel hub, blades which extend radially into respective working spaces of the drive wheel and divide each of the working spaces into, two mutually counteracting hydraulic pressure chambers. The pressure chambers of each working space are sealed one against the other. When they are pressurized simultaneously, or selectively, with hydraulic fluid from a hydraulic fluid circuit, generally with engine oil, it effects a swivel motion or fixes the rotor relative to the stator, and thus of the camshaft relative to the crankshaft.

Many of the newer rotation angle adjusting devices are integrated in the drive system of the camshaft, in the so-called control gear. In this case, mechanical vibrations are transmitted. During engine running, vibrations are generated in the crank gear, the control gear or the valve gear. If the drive wheel is operatively connected to the crankshaft, for example by a belt or a chain, the device, moreover, converts a translatory motion into a rotary motion. This conversion additionally generates mechanical vibrations.

Since, in rotation angle adjusting devices, power is transmitted by hydraulically clamped blades on the basis of the vane-cell principle, the hydraulic fluid circuit of the internal combustion engine is incorporated into the power transmission for the drive of the camshaft. Owing to air entrapment in the hydraulic fluid and internal and external oil leakage, only a limited torsional rigidity between the drive side and the power-take-off side on the device is possible. The aforementioned mechanical vibrations can therefore be transmitted to the hydraulic fluid circuit of the internal combustion engine. If the device is unfavorably disposed in the control gear, high pressures or pressure peaks, in excess of 200 bar, can consequently be generated.

In particular, if a plurality of rotation angle adjusting devices are mutually connected, for example, by a chain drive and are adjusted in phase opposition, the chain can sag. If the devices are then readjusted in phase opposition but in the opposite direction, this produces sudden high chain tensions, which are transmitted via the stators into the pressure chambers, to the hydraulic fluid, and there give rise to the pressure peaks. The greater the difference in the rotation angle of the devices, the higher are these peaks. Also, if the relative phase position of the camshaft is unfavorable, for example through increasing overlapping of the valve curves, this can result in sudden chain tensions. If the inlet cam, for example, is in the region of the lifting flank, and the outlet cam is in the region of the dropping flank, forces are generated in mutually opposed directions and this can then again give rise to the pressure peaks.

These pressure peaks are damaging both to the device and to the internal combustion engine. They reduce the durability of components in direct contact with the hydraulic fluid circuit. They adversely affect the working of hydraulically controlled systems in this hydraulic fluid circuit, such as a hydraulic chain tensioner.

To solve this problem, DE 198 37 693 A1 proposes to connect upstream of the hydraulic fluid ports of the pressure chambers, respective non-return valves, which shut off in the direction of the hydraulic pump. However, this only allows the elimination of pressure peaks which derive from camshaft alternating moments and are not high-frequency. Furthermore, additional assembly input is required to integrate further components into the hydraulic fluid circuit.

OBJECT OF THE INVENTION

In a hydraulic fluid circuit of an internal combustion engine provided with a rotation angle adjusting device, the object of the invention is to reduce pressure fluctuations as far as possible and thus, in particular, to eliminate pressure peaks.

SUMMARY OF THE INVENTION

This object is achieved according to the invention. Accordingly, a volume accumulator is disposed in the hydraulic fluid circuit, between the rotation angle adjusting device and the associated hydraulic valve. Its volume is variable and is solely determined by the pressure in the hydraulic fluid circuit. If the pressure in the hydraulic fluid circuit then increases abruptly, the volume available to the hydraulic fluid is increased by the volume accumulator. This volume release counteracts the change in pressure. In the reverse case, the volume accumulator reduces the volume available for the hydraulic fluid in the hydraulic fluid circuit. If the inertia of the volume accumulator is low, it can also act as an oscillating circuit damper and counteract a pulsation generated by a pressure peak.

The volume accumulator is configured, for example, as a compression-spring-controlled piston accumulator. It comprises in this case a piston, which is positioned in a blind hole, and an axially acting spring element. A rotary spring element would also, however, be conceivable. The piston is here made up of a piston head, which can be pressurized with hydraulic fluid, and a piston skirt. The function of the piston skirt is 1. to guide the piston axially in the blind hole
2. to receive the spring element and
3. to limit the axial travel thereof, in that it comes to rest on the bottom of the blind hole.

The spring element, configured, for example, as a helical spring, is located in the piston and stands opposite the open side of the piston. By selecting a spring element having a spring constant determined by the system, it is possible to fix a suitable opening pressure, at which the piston gets the chance to shift axially in the direction of the bottom of the blind hole and thus to increase the volume of the hydraulic fluid system.

In order to limit the leakage behind the piston, the blind hole bore can be realized as a clearance fit. The leakage, which, despite the fit, is present behind the piston, is evacuated through a ventilation bore to prevent the travel of the piston from being prematurely limited. In place of a ventilation bore, the space behind the piston can also be sealed by a seal.

In the event of a pressure drop in the hydraulic fluid system, under the opening pressure of the piston accumulator, the spring element attempts to force the piston in the direction of the hydraulic fluid system and may possibly close off a hydraulic fluid line. To prevent this undesirable effect and bias the spring in accordance with the opening pressure, a forward-acting travel limiter is introduced into the hydraulic fluid system. This may be an additional structural element, which is disposed, for example, in the hydraulic fluid line or in the volume accumulator, but can also be effected by suitable shaping of the piston head. The bias is here chosen such that a volume flow in the hydraulic fluid system is in any event possible, even if the system is devoid of pressure.

It is particularly advantageous to dispose the volume accumulator in the actual rotation angle adjusting device, since it is there that the pressure peaks are transmitted into the hydraulic fluid. In the first place, therefore, they are equalized as quickly as possible. In the second place, the least possible number of components supplied by the hydraulic fluid system are affected. In the third place, an integrated solution saves space and reduces the assembly input.

In order simultaneously to reduce the number of components, it is further proposed according to the invention to use a locking unit of the device, which, in the event of insufficient pressure in the hydraulic fluid system, fixes the device in a fixed position, simultaneously as a volume accumulator. Since locking units are present in all modern rotation angle adjusting devices, manufacturing work steps can be saved or be dropped.

If insufficient construction space is available in the device, however, further volume accumulators can be disposed in the hydraulic fluid lines leading to the pressure chambers.

The volume accumulator can also be realized as a bladder accumulator or as a diaphragm accumulator. Both types of accumulator serve, just like the piston accumulator, to increase the volume for the hydraulic fluid in the hydraulic fluid system in order to eliminate pressure fluctuations. Any selected resilient element can be used as the element supporting the bladder or diaphragm accumulator. The basic advantages of these solutions over the piston spring accumulator lie in their quicker responsiveness. In return, a larger volume can be temporarily stored with a piston spring accumulator.

The diaphragm of a diaphragm accumulator has a low inertia relative to a solution involving a piston spring accumulator. Considerably higher vibration frequencies are thus possible. As a result of its frequency-complementary characteristics relative to the piston spring accumulator, a combination of these two solutions is particularly suitable. The most high-frequency vibrations have a low amplitude and can thus be easily absorbed by a diaphragm. The lower-frequency vibrations have a greater amplitude, calling for a larger compensation volume, which can be better realized with a piston spring accumulator. Because of the lower frequency, a more sluggish response characteristic by comparison with the diaphragm is here not a drawback.

A bladder accumulator, too, reacts very quickly to pressure changes. Its efficiency reaches almost 100% and it works virtually without friction and free from inertia.

Volume accumulators according to the invention absorb dynamic pressure changes in the hydraulic fluid system and, in addition, any pulsation of the volume flow is diminished. Improvement in the reliability of the rotation angle adjusting device and other hydraulic systems in the internal combustion engine is thus achieved. In addition, the durability of seals and other components is increased.

Furthermore, choosing a suitable bias enables creating a spare volume in the hydraulic fluid circuit. In the short term, this can cover an increased hydraulic fluid requirement generated, for example, by performance peaks. Faster responsiveness is obtained and higher starting accelerations are possible, since, in addition to the hydraulic fluid volume, the volume of the volume accumulator is also available to the pump of the device.

Other features and advantages of the present invention will become apparent from the following description of the invention which refers to the accompanying drawings.

BRIEF DESCRIPTION OF THE DRAWINGS

The invention is explained in detail below with reference to five illustrative embodiments. In the associated drawings.

DETAILED DESCRIPTION OF PREFERRED EMBODIMENTS

Figure 1A:
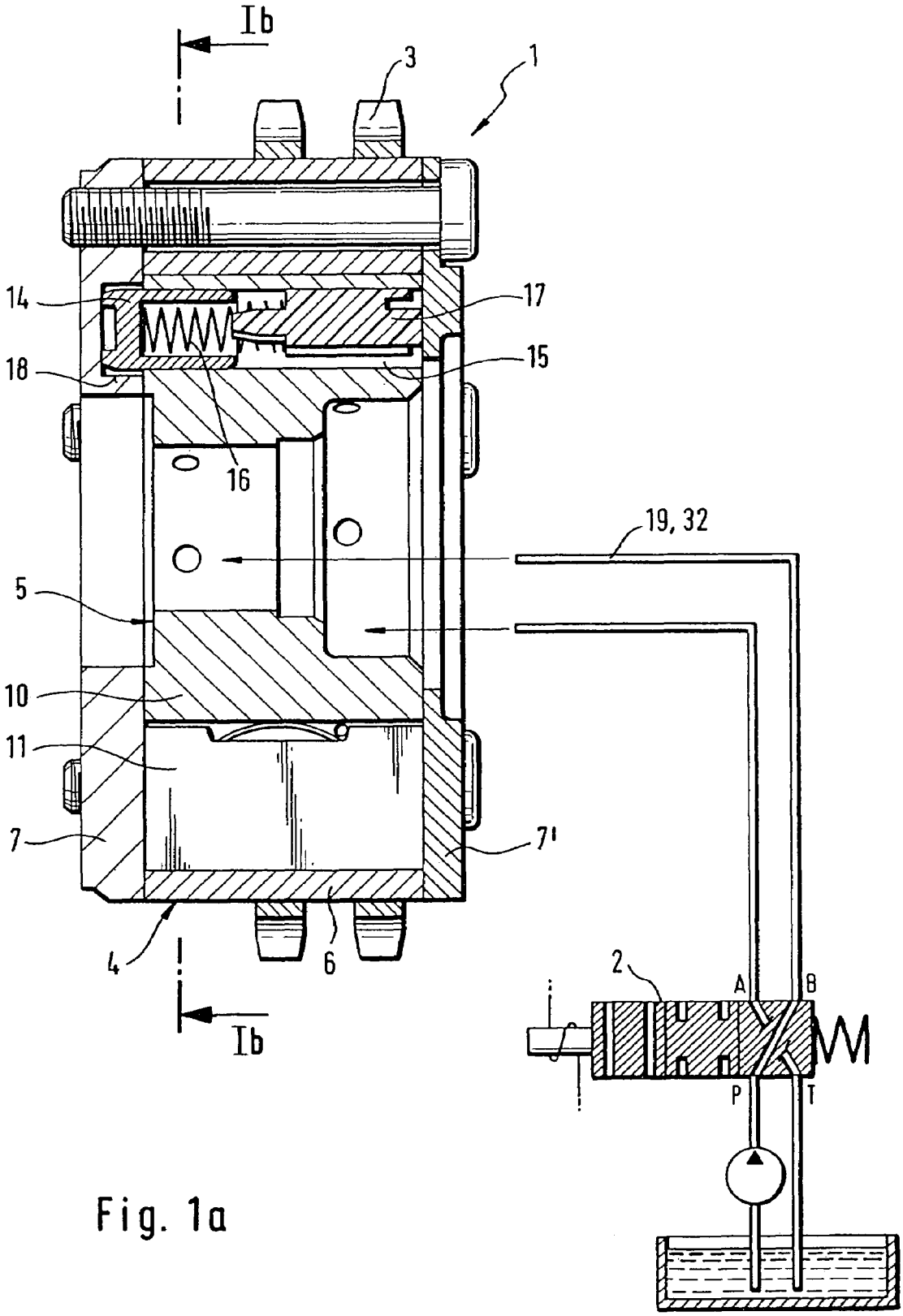
FIG. 1*a* shows a longitudinal section of a hydraulic-action rotation angle adjusting device along the axis Ia—Ia in FIG. 1*b*.
Figure 1B:
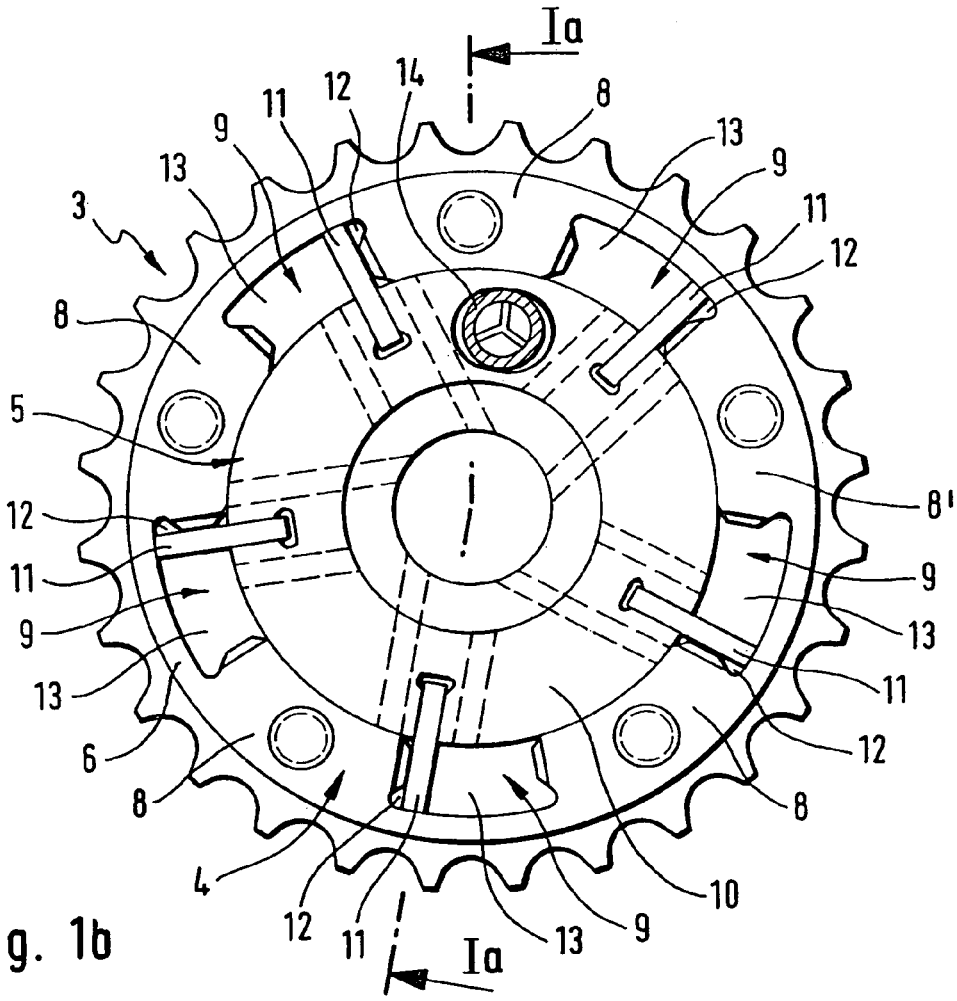
FIG. 1*b* shows a cross section of the device of FIG. 1*a* along the axis Ib—Ib in FIG. 1*a*.

A device 1 for adjusting the rotation angle between a crankshaft (not represented) and a camshaft (likewise not represented) is shown in FIGS. 1*a* and 1*b*. This device 1 is attached as a rotation piston adjusting device to the drive-side end of the camshaft mounted in the cylinder head (not represented) of an internal combustion engine and is configured, in principle, as a hydraulic actuating drive, which is controlled dependent on various operating parameters of the internal combustion engine by a hydraulic valve 2, via hydraulic fluid lines 19 of a hydraulic fluid system 32.

The device 1 essentially comprises a stator 4, which is drive-connected to the crankshaft by a drive wheel 3, and a rotor 5, which is connected in a rotationally secure manner to the camshaft. The rotor 5 is pivotably mounted in and is in power-transmission connection with the drive wheel 3. The drive wheel 3 in this case has a cavity, which is formed by a hollow-cylindrical peripheral wall 6 and two side walls 7, 7'. Hydraulic work spaces 9 are evenly distributed over the periphery by radial reference walls 8, 8' directed toward the longitudinal center axis of the device 1. Consequently, the rotor 5 has blades 11 on the periphery of its wheel hub 10, and the blades are evenly distributed over the periphery and each blade extends respectively into a work space 9 of the drive wheel 3. The blades 11 divide each work space 9 into, respectively, an A-pressure chamber 12 and a B-pressure chamber 13, which, when pressurized simultaneously, or selectively, with a hydraulic fluid, effect a swivel motion or a fixation of the rotor 5 relative to the stator 4, and thus a rotation angle adjustment or a hydraulic clamping of the camshaft relative to the crankshaft.

Likewise, a locking element 14 prevents an impact rattling of the rotor 5, resulting from the alternating moments of the camshaft when the internal combustion engine is started. When the hydraulic fluid pressure falls below a level which is necessary to the adjustment, the locking element 14, in a preferred basic position within its range of adjustment, is mechanically coupled to the stator 4. It is configured as a sleeve-like cylinder pin and is disposed in a continuous axial bore 15 in the wheel hub 10 of the rotor. A locking spring element 16, which rests, on the one hand, against the rear side of the locking element 14 and, on the other hand, against a brace 17, likewise inserted in the axial bore 15, is capable of displacing the locking element 14 within a receiving fixture 18 in that side wall 7 of the drive wheel 3 which faces away from the camshaft. The A-pressure chambers 12 and B-pressure chambers 13 are connected to the hydraulic valve 2 by hydraulic fluid lines 19. A volume accumulator 20 is disposed in the hydraulic fluid lines 19.

Figure 2:
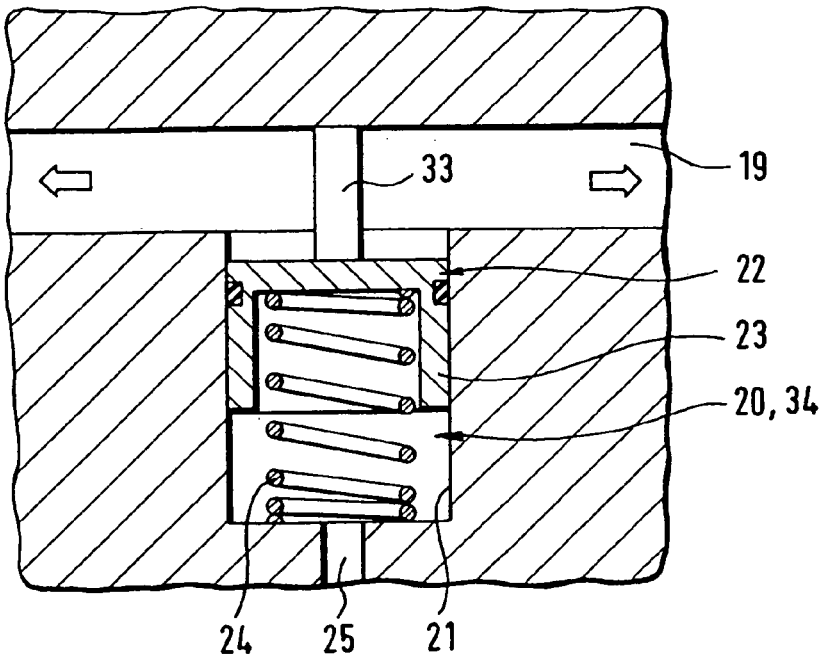
FIG. 2 shows a cross section of a volume accumulator in piston form.

FIG. 2 shows a cross section of a volume accumulator 20 configured as a piston accumulator 34. It is configured as a blind hole 21 and directly adjoins the hydraulic fluid line 19. A piston 22 having a piston skirt 23 is disposed in a blind hole 21. The piston skirt 23 guides the piston 22 axially in the blind hole 21 and also receives a spring element 24. The shape of the skirt limits axial spring travel, in that the spring comes to rest on the bottom of the blind hole 21 should the spring element 24 be substantially deflected. A change in pressure in the hydraulic fluid line 19 deflects the spring element 24, which changes the volume available for the hydraulic fluid. The change in volume counteracts the change in pressure. The choice of a suitable spring element 24 or the provision of a travel limiter 33 for the piston here ensures that the hydraulic fluid line 19 is never totally closed. To limit oil leakage from the hydraulic fluid line 19 to the area behind the piston 22, the blind hole 21 is configured as a clearance fit. Oil leakage, which is present behind the piston despite the fit, is evacuated, for example, through a ventilation bore 25. Thus, travel of the piston 22 is not prematurely limited.

The volume accumulator 20 can be configured as a separate unit, or it is integrated in the locking element 14. In this case, the axial bore 15 corresponds to the blind hole 21 and the piston 22 corresponds to the locking element 14.

Figure 3A:
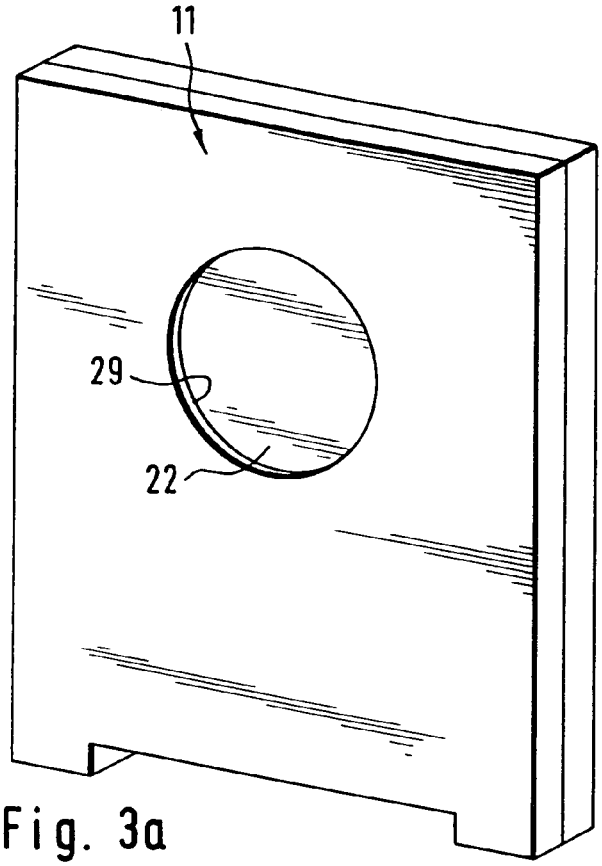
FIG. 3*a* shows a perspective representation of a blade of a rotation angle adjusting device having an integrated piston spring accumulator.
Figure 3B:
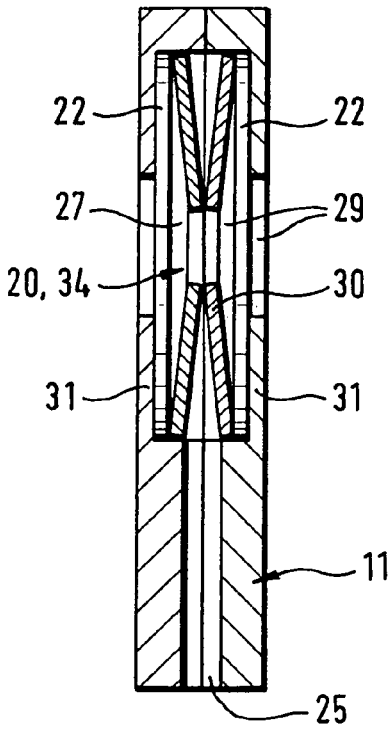
FIG. 3*b* shows a cross section of the blade from FIG. 3*a*.

FIGS. 3*a* and 3*b* show a volume accumulator 20 integrated in a rotor blade 11. The blade 11 is of two-part configuration and has a pass-through opening 29. In the radial direction, the blade 11 contains at least one cavity 27, in which two pistons 22, realized as disks, are inserted in such a way that the pistons 22 close the pass-through opening 29 at both axial sides. The pistons 22 are mutually supported by cup springs 30 and are supported on the other, outer side by the respective marginal region 31 of the blades 11. A different, elastic element may also be used in place of cup springs 30. A rise in pressure in one of the two chambers 12, 13 in the device 1 causes displacement of the piston 22 and thus produces a change in volume of the chamber. The air which is here displaced in the cavity 27 is evacuated through a ventilation bore 25 connected to the cavity 27, just like a potential leakage of hydraulic fluid.

Figure 4:
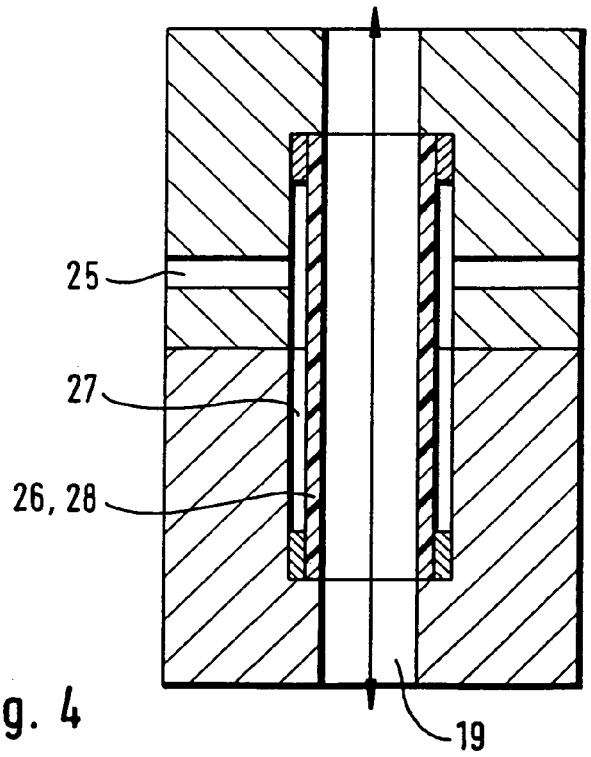
FIG. 4 shows a longitudinal section of a volume accumulator having elastic walls.

FIG. 4 shows a volume accumulator 20, which is realized by a diaphragm accumulator configured as an elastic tube 26. In this configuration, a cavity 27 in the hydraulic fluid lines 19 contains the elastic tubes 26. These tubes are comprised of plastic or metal. In this configuration, the elastic tube 26 simultaneously assumes the function of the piston 22 and of the spring element 24 of the piston accumulator version. In the event of a pressure increase in the hydraulic fluid line, air and any oil leakage can escape from the cavity 27 through ventilation bores 25. The spring constant of the system is defined by the design of the elastic tube 26. Expediently, the diaphragm is stuck in place or clamped in place.

Instead of being in the form of a resilient elastic tube 26, the diaphragm 28 can also be shaped as a bladder and can act as a working component of a bladder accumulator disposed in the hydraulic fluid line 19. The gas-filled bladder is locally fixed and its expansion is governed by the pressure surrounding it.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A hydraulic device for adjusting a rotation angle of a camshaft relative to a crankshaft of an internal combustion engine, the device comprising:

a rotor having a periphery and blades arranged around the rotor periphery and projecting outwardly, the rotor connectable in a rotationally secure manner to the camshaft;

a stator connectable in a rotationally secure manner to a drive wheel driven by the crankshaft, the rotor being relatively rotatable with respect to the stator; and a first pressure chamber and a second pressure chamber provided respectively on both circumferential sides of each blade;

a hydraulic fluid system having at least one hydraulic valve and being connected to the first and second pressure chambers which are selectively pressurized or depressurized with hydraulic fluid through hydraulic fluid lines; and a volume accumulator being located in a location selected from the group consisting of the device and between the hydraulic valve and a remainder of the device other than the hydraulic valve and the volume accumulator, the hydraulic fluid system and the volume accumulator being operable such that a volume of hydraulic fluid in the volume accumulator is at all times solely determined by pressure in the hydraulic fluid system.

2. The device as claimed in claim 1, wherein the volume accumulator is disposed in the rotation angle adjusting device.

3. The device as claimed in claim 1, wherein the volume accumulator is configured as a diaphragm accumulator.

4. The device as claimed in claim 1, wherein the volume accumulator is configured as a bladder accumulator.

5. The device as claimed in claim 1, wherein the volume accumulator is configured as a compression-spring-controlled piston accumulator, comprising a piston and a spring element acting on the piston to drive the piston toward reducing volume.

6. The device as claimed in claim 5, wherein the spring element is biased to act.

7. The device as claimed in claim 5, wherein the piston has a side facing away from the hydraulic fluid system at which the piston has a ventilation bore.

8. The device as claimed in claim 5, further comprising a travel limiter disposed in the volume accumulator or in the hydraulic fluid system and positioned for limiting the travel of the spring element in the direction of the hydraulic fluid system.

9. The device as claimed in claim 1, wherein the volume accumulator is positioned in a position selected from the group consisting of directly adjoining a hydraulic fluid line of the hydraulic fluid lines, within a hydraulic fluid line of the hydraulic fluid lines, and disposed in a rotor blade.

10. A hydraulic device for adjusting a rotation angle of a camshaft relative to a crankshaft of an internal combustion engine, the device comprising:

a rotor having a periphery and blades arranged around the rotor periphery and projecting outwardly, the rotor connectable in a rotationally secure manner to the camshaft;

a stator connectable in a rotationally secure manner to a drive wheel driven by the crankshaft, the rotor being relatively rotatable with respect to the stator;

a first pressure chamber and a second pressure chamber provided respectively on both circumferential sides of each blade;

a hydraulic fluid system having at least one hydraulic valve and being connected to the first and second pressure chambers which are selectively pressurized or depressurized with hydraulic fluid through hydraulic fluid lines; and a volume accumulator between the hydraulic valve and a remainder of the device other than the hydraulic valve and the volume accumulator, wherein the volume accumulator is disposed in the rotor blade.

11. The device as claimed in claim 10, wherein the blades have a marginal region and the volume accumulator is supported to the marginal regions of the blades.

12. The device as claimed in claim 11, further comprising cup springs supporting the marginal regions of the blades.

13. A hydraulic device for adjusting a rotation angle of a camshaft relative to a crankshaft of an internal combustion engine, the device comprising:

a rotor having a periphery and blades arranged around the rotor periphery and projecting outwardly, the rotor connectable in a rotationally secure manner to the camshaft;

a stator connectable in a rotationally secure manner to a drive wheel driven by the crankshaft, the rotor being relatively rotatable with respect to the stator;

a locking element operable to fix the rotor relative to the stator;

a first pressure chamber and a second pressure chamber provided respectively on both circumferential sides of each blade;

a hydraulic fluid system having at least one hydraulic valve and being connected to the first and second pressure chambers which are selectively pressurized or depressurized with hydraulic fluid through hydraulic fluid lines; and a volume accumulator integrated in the locking element.

* * * * *